US005486126A

United States Patent [19]

Cathey et al.

[11] Patent Number: 5,486,126

[45] Date of Patent: Jan. 23, 1996

[54] SPACERS FOR LARGE AREA DISPLAYS

[75] Inventors: David A. Cathey; James J. Hofmann; Danny Dynka; Darryl M. Stansbury, all of Boise, Id.

[73] Assignee: Micron Display Technology, Inc., Boise, Id.

[21] Appl. No.: 349,091

[22] Filed: Nov. 18, 1994

[51] Int. Cl.[6] ..... H01J 9/18

[52] U.S. Cl. ..... 445/25; 29/423

[58] Field of Search ..... 445/24, 25

[56] References Cited

U.S. PATENT DOCUMENTS

| | | | |
|---|---|---|---|
| 4,183,125 | 1/1980 | Meyer et al. | 425/24 |
| 4,705,205 | 11/1987 | Allen et al. | 228/180.22 |
| 4,923,421 | 5/1990 | Brodie et al. | 425/24 |
| 5,175,287 | 12/1992 | Lee et al. | 544/183 |
| 5,232,549 | 8/1993 | Cathey et al. | 445/24 X |
| 5,329,207 | 7/1994 | Cathey et al. | 445/24 X |

OTHER PUBLICATIONS

Carter et al., Chemotherapy of Cancer, 2nd Ed, John Wiley & Sons, N.Y. N.Y. (1981) pp. 107 and 108.

Holden et al., JNCL 84:187–193 (1992).

*Primary Examiner*—Kenneth J. Ramsey

*Attorney, Agent, or Firm*—Lia M. Pappas

[57] ABSTRACT

A process is provided for forming spacers useful in large area displays. The process comprises steps of: forming bundles comprising fiber strands which are held together with a binder; slicing the bundles into slices; adhering the slices on an electrode plate of the display; and removing the binder.

28 Claims, 4 Drawing Sheets

SPACERS FOR LARGE AREA DISPLAYS

FIELD OF THE INVENTION

This invention relates to flat panel display devices, and more particularly to processes for creating the spacer structures which cam provide support against the atmospheric pressure on the flat panel display without impairing the resolution of the image.

BACKGROUND OF THE INVENTION

It is important in flat panel displays of the field emission cathode the that an evacuated cavity be maintained between the cathode electron emitting surface and its corresponding anode display face (also referred to as an anode, cathodoluminescent screen, display screen, faceplate, or display electrode).

There is a relatively high voltage differential (e.g., generally above 300 volts) between the cathode emitting surface (also referred to as base electrode, baseplate, emitter surface, cathode surface) and the display screen. It is important that catastrophic electrical breakdown between the electron emitting surface and the anode display face be prevented. At the Same time, the narrow spacing between the plates is necessary to maintain the desired structural thinness and to obtain high image resolution.

The spacing also has to be uniform for consistent image resolution, and brightness, as well as to avoid display distortion, etc. Uneven spacing is much more likely to occur in a field emission cathode, matrix addressed flat vacuum type display than in some other display types because of the high pressure differential that exists between external atmospheric pressure and the pressure within the evacuated chamber between the baseplate and the faceplate. The pressure in the evacuated chamber is typically less than $10^{-6}$ torr.

Small area displays (e.g., those which are approximately 1" diagonal) do not require spacers, since glass having a thickness of approximately 0.040" can support the atmospheric load without significant bowing, but as the display area increases, spacer supports become more important. For example, a screen having a 30" diagonal measurement will have several tonnes of atmospheric force exerted upon it. As a result of this trenendous pressure, spacers will play an essential role in the structure of the large area, light weight, displays.

Spacers are incorporated between the display faceplate and the baseplate upon which the emitter tips are fabricated. The spacers, in conjunction with thin, lightweight, substrates support the atmospheric pressure, allowing the display area to be increased with little or no increase in substrate thickness.

Spacer structures must conform to certain parameters. The supports must 1) be sufficiently non-conductive to prevent catastrophic electrical breakdown between the cathode array and the anode, in spite of the relatively close inter-electrode spacing (which may be on the order of 200 μm), and relatively high inter-electrode voltage differential (which may be on the order of 300 or more volts); 2) exhibit mechanical strength such that they prevent the flat panel display from collapsing under atmospheric pressure; 3) exhibit stability under electron bombardment, since electrons will be generated at each of the pixels; 4) be capable of withstanding "bakeout" temperatures of around 400° C. that are required to create the high vacuum between the faceplate and backplate of the display; and 5) be of small enough width so as to not to visibly interfere with display operation.

There are several drawbacks to the current spacers and methods. Methods employing screen printing, stencil printing, or glass balls suffer from the inability to provide a spacer having a sufficiently high aspect ratio. The spacers formed by these methods are either too short to support the high voltages, or are too wide to avoid interfering with the display image.

Reactive ion etching (R.I.E.) and plasma etching of deposited materials suffer from slow throughput (i.e., time length of fabrication), slow etch rates, and etch mask degradation. Lithographically defined photoactive organic compounds result in the formation of spacers which are not compatible with the high vacuum conditions or elevated temperatures characteristic in the manufacture of field emission flat panel displays.

SUMMARY OF THE INVENTION

One aspect of the present invention is a process for forming spacers useful in large area displays. The process comprises steps of: forming bundles comprising fiber strands which are held together with a binder; slicing the bundles into slices; adhering the slices on an electrode plate of the display; and removing the binder.

Another aspect of the present invention is a method of manufacturing micro-pillars comprising steps of: forming a bundle of glass fibers which are held together with a binder and slicing the bundles of glass fibers. The glass fibers having ends which are polished, after which the binder near the ends of the glass fibers is etched back. Disposing the slices onto a plate which supports against the atmospheric pressure in a flat panel display. The binder is then removed, thereby creating micro-pillars.

A further aspect of the present invention is a process for fabricating high-aspect ratio support structures comprising: printing adhesive on an electrode plate of a vacuum display; disposing slices on the adhesive, wherein the slices comprise fibers and subsequently employing some of the fibers as a physical support in an evacuated display cavity.

BRIEF DESCRIPTION OF THE DRAWINGS

The present invention will be better understood from reading the following description of nonlimitative embodiments, with reference to the attached drawings, wherein below.

DETAILED DESCRIPTION OF THE INVENTION

Figure 1:
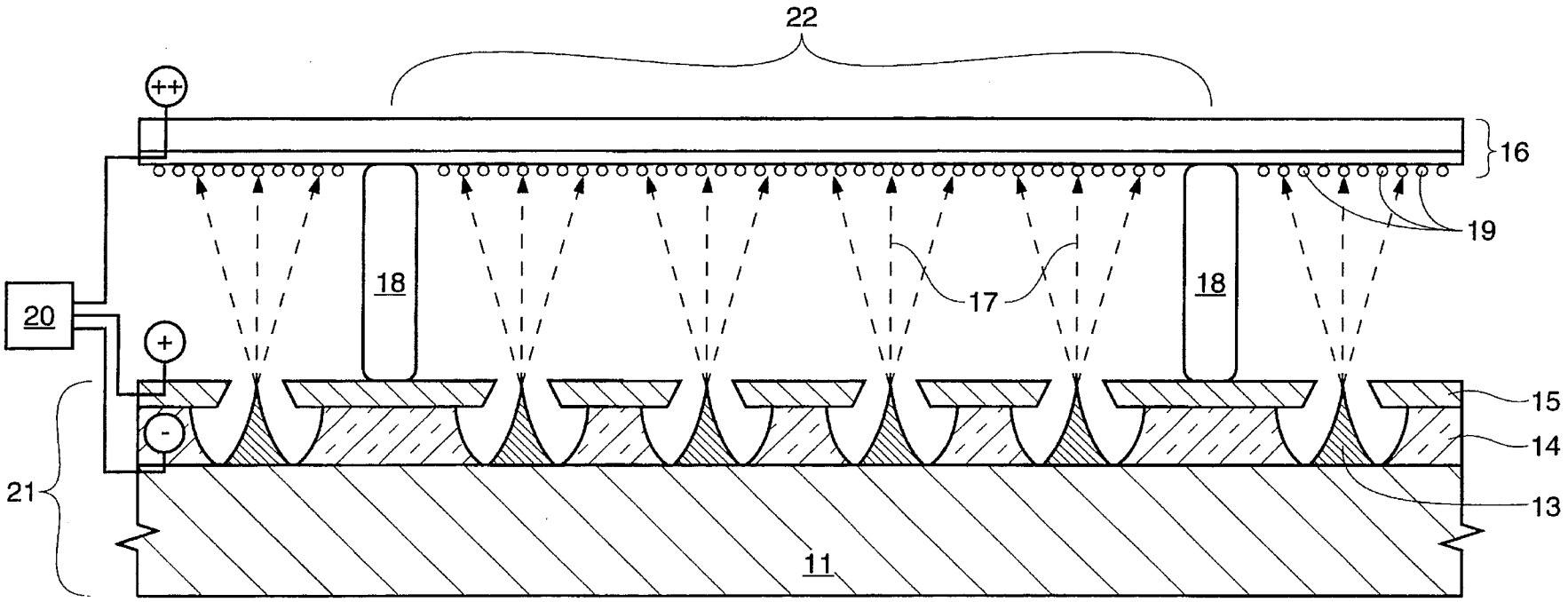
FIG. 1 is a schematic cross-section of a representative pixel of a field emission display comprising a faceplate with a phosphor screen, vacuum sealed to a baseplate which is supported by the spacers formed according to the process of the present invention.

Referring to FIG. 1, a representative field emission display employing a display segment 22 is depicted. Each display segment 22 is capable of displaying a pixel of information, or a portion of a pixel, as, for example, one green dot of a red/green/blue full-color triad pixel.

Preferably, a silicon layer serves as an emission site on glass substrate 11. Alternatively, another material capable of conducting electrical current is present on the surface of a substrate so that it can be used to form the emission site 13.

The field emission site 13 has been constructed on top of the substrate 11. The emission site 13 is a protuberance which may have a variety of shapes, such as pyramidal, conical, or other geometry which has a fine micro-point for the emission of electrons. Surrounding the micro-cathode 13, is a grid structure 15. When a voltage differential, through source 20, is applied between the cathode 13 and the grid 15, a stream of electrons 17 is emitted toward a phosphor coated screen 16. Screen 16 is an anode.

The electron emission site 13 is integral with substrate 11, and serves as a cathode. Gate 15 serves as a grid structure for applying an electrical field potential to its respective cathode 13.

A dielectric insulating layer 14 is deposited on the conductive cathode 13, which cathode 13 can be formed from the substrate or from one or more deposited conductive films, such as a chromium amorphous silicon bilayer. The insulator 14 also has an opening at the field emission site location.

Disposed between said faceplate 16 and said baseplate 21 are located spacer support structures 18 which function to support the atmospheric pressure which exists on the electrode faceplate 16 and baseplate 21 as a result of the vacuum which is created between the baseplate 21 and faceplate 16 for the proper functioning of the emitter sites 13.

The baseplate 21 of the invention comprises a matrix addressable array of cold cathode emission sites 13, the substrate 11 on which the emission sites 13 are created, the insulating layer 14, and the anode grid 15.

The process of the present invention provides a method for fabricating high aspect ratio support structures to function as spacers 18. Briefly, the process of the present invention is a fiber approach. There are a number of process steps from raw fiber to assembled spacer 18.

Figure 2A:
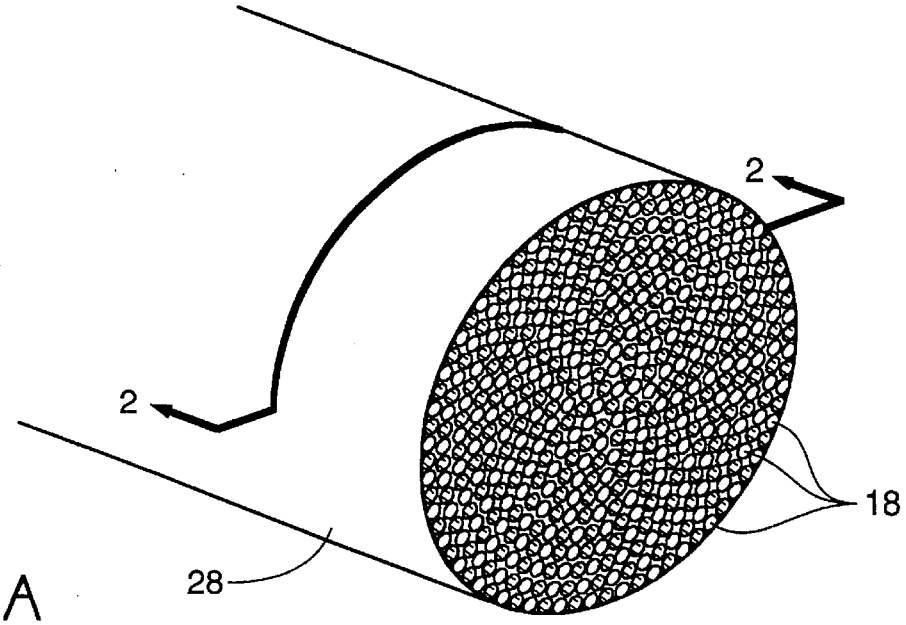
FIG. 2A is a schematic cross-section of a fiber bundle fabricated, according to the process of the present invention.
Figure 2B:
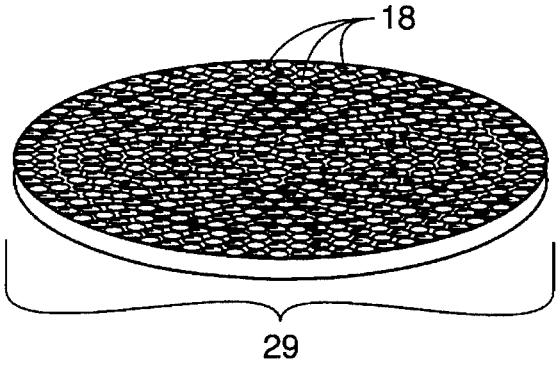
FIG. 2B is a schematic cross-section of a slice of the fiber bundle of FIG. 2 along lines 2—2, fabricated according to the process of the present invention.
Figure 3:
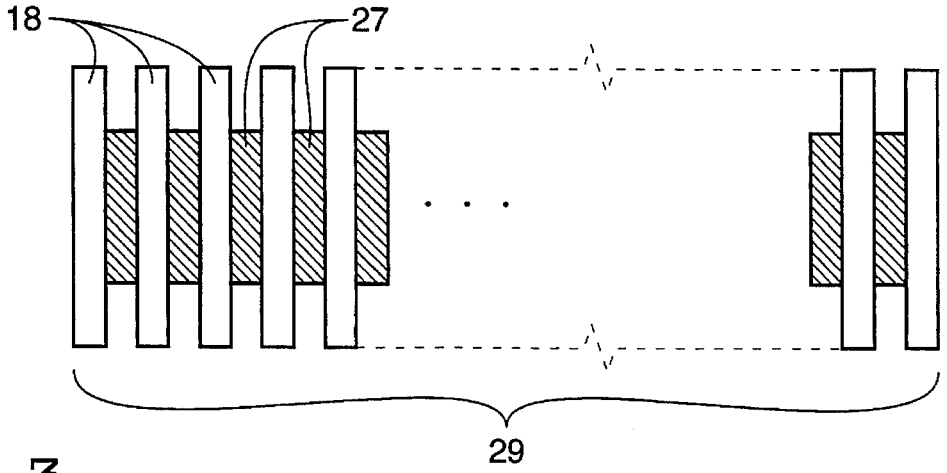
FIG. 3 is an enlarged schematic cross-section of the slice of the fiber bundle of FIG. 2A, fabricated according to the process of the present invention.

In one embodiment, glass fibers, 25 μm. in diameter, are mixed with organic fibers 27 such as nylon or PMMA (polymethylmethacrylate) and a bundle 28 is formed, as shown in FIGS. 2A, 2B, and 3. The PMMA fibers 27 help to maintain a substantially uniform distance between the glass fibers 18.

In another embodiment, a removable interfiber binder (not shown), such as an acetone soluble wax is added to hold the fibers 18 together. In this embodiment of the present invention, the fiber bundle 28 is formed with a dissoluble matrix. Some examples of dissoluble matrices include, but are not limited to:

a. acryloid acrylic plastic resin in an acetone/toluene solvent;

b. Zein$_{TM}$, corn protein in IPA/water based solvent, which is a food and drug coating;

c. acryloid/Zein$_{TM}$, which is a two-layer system;

d. polyvinyl alcohol (PVA) resist in water;

e. polyvinyl alcohol (PVA) with ammonium dichromate (ADC) in water; and f. a wax, such as those manufactured by Kindt-Collins, Corp.

One important issue relating to spacers 18 in field emitter displays is the potential for stray electrons to charge up the surface of a purely insulative spacer surface 18 over time, eventually leading to a violent arc discharge causing a destruction of the panel.

Since the process of the present invention is based on fibers 18, it therefore lends itself to the advantageous ability of using coated fibers (not shown), or fibers with a treated surface prior to bundling. A temporary coating is employed so that the removable coating that provides spacing between fibers 18 may be applied to individual fibers prior to bundling, or to several fibers 18 at a time in a bundle 28 or in close proximity. Hence, the spacing between the fibers 18 comprising the bundle 28 is accomplished through the use of a removable coating.

The fibers 18 may also employ a permanent coating to provide a very high resistivity, on the surface, but are not purely insulative, so that the coated fibers 18 allow a very slight bleed off to occur over time, thereby preventing a destructive arc over. Highly resistive silicon is one example of a thin coating that is useful on the fiber 18.

In another alternative embodiment, the glass fibers 18, and the acetone soluble PMMA fibers 27 are used together in a mixed fiber bundle 28. The PMMA fibers 27 provide a physical separation between glass fibers 18, and can be dissolved after the disposition of the fiber bundle slices 29 on the display plate 16, 21.

A 6"×8" field emission display (FED) with a large ½" outer border between the active viewing area and the first edge has to support a compressive atmospheric pressure applied to it of approximately 910 lb. It is worth noting that for a single 25 μm diameter, 200 μm tall quartz column, the buckle load is 0.006 lb.

Excluding the bow resistance of the glass faceplate 16, the display would require 151,900, 25 μm×200 μm columns 18 to avoid reaching the buckle point. With roughly 1 million black matrix 25 street intersections on a color VGA display, the statistical capability of adhering that number of fibers 18 is useful in providing a manufacturable process window.

The mixed fiber bundle 28 of FIG. 2A is then sliced into thin discs 29, as shown in FIGS. 2B and 3. The bound fibers 28 are sliced to about the desired thickness, which is approximately 0.008" to 0.013". In the process of the present invention, a saw is used to slice the fiber bundle 28 into discs or slices 29.

Dots of adhesive 26 are provided at the sites where the spacers 18 are to be located. The preferred areas on which to apply the adhesion dots 26 are in the black matrix regions 25.

Figure 4:
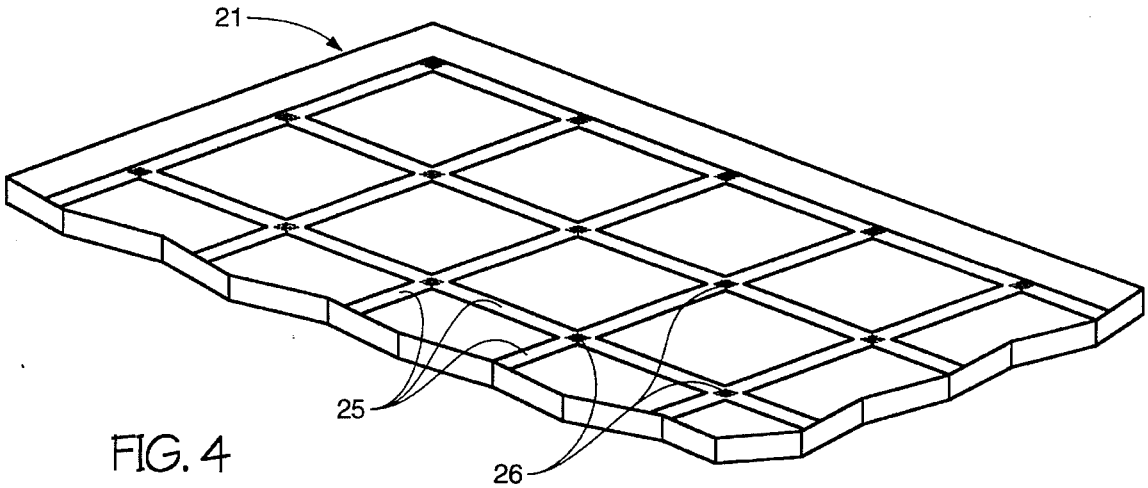
FIG. 4 is a schematic cross-section of the electrode plate of a flat panel display without the slices of FIG. 3 disposed thereon.

A screen printing system is used to generate the predetermined adhesion sites 26 in thousands of locations on the display plate 16, 21. Alternatively, the adhesion sites 26 are lithographically defined, or formed with an XY dispense system. FIG. 4 illustrates a display plate 16, 21 on which are disposed adhesion sites 26 located in the black matrix regions 25. The black matrix regions 25 are those regions where there is no emitter 13 or phosphor dot. In these sites 25, the support pillars 18 do not distort the display image.

Dupont Vacrel is an example of a dry film that can be adapted to a glass substrate, exposed to a pattern at approximately 400 nm. wavelengths, and developed in 1% $K_2CO_3$ solution. This process results in a stencil that can be used to define the glue dots 26. After removing excess adhesive, the film is peeled off. This method has the advantage of being alignable with projector/alignor accuracy.

Two materials which may be used to form adhesion sites are: 1) two part epoxies are thermally cured from room temperature to approximately 200° C. The epoxies are stable on a short term basis from 300° C.–400° C. several are good in the range of 500° C.–540° C.; and 2) a cement composed of silica, alumina, and a phosphate binder. This material has a fair adhesion to glass, and cures at room temperature.

The slices 29 are disposed all about the display plate 16, 21, but the micro-pillars 18 are formed only at the sites of the adhesion dots 26. The fibers 18 which contact the adhesion dots 26 remain on the plate 16, 21, and the remainder of the fibers 18 are removed by subsequent processing.

There are many more adhesion dots 26 than the final number of micro-pillars 18 required for the display. Therefore, the placement of the slices 29 upon the plate 16, 21 does not require a high degree of placement accuracy. The number and area of the dots 26 and fiber 18 density in the slices are chosen to produce a reasonable yield of adhered micro-pillars 18. A fiber 18 bonds to the display plate 16, 21 only when the fiber 18 overlaps an adhesion dot 26, as illustrated shown in FIG. 6.

Figure 5:
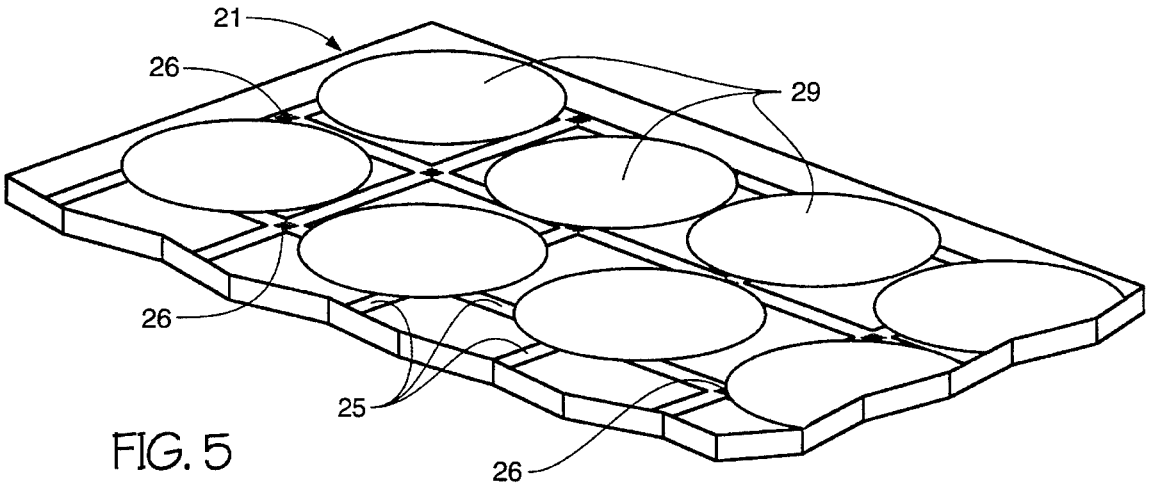
FIG. 5 is a schematic cross-section of an electrode plate of a flat panel display with the slices of FIG. 3 disposed thereon.

FIG. 5 shows the manner in which the discs 29 are placed in contact with the predetermined adhesion sites 26 on the black matrix region 25 on the faceplate 16 or in a corresponding location to the black matrix along the baseplate 21.

Planarizing may be done at this point. Depending on how well the previous steps were carried out, the fibers 18 are either all the correct height, or slightly uneven. Most will be uneven. A light polish with 500–600 grit paper usually planarizes the bonded mats 29 without causing breakage or adhesion loss.

The display plate 16, 21 with slices 29 disposed thereon (FIG. 4) may be clamped or forced against a surface 21 to enhance adhesion and the perpendicular arrangement of the fibers 18 to the plate 16, 21. When the glass fiber 18 is temporarily adhered, the organic fibers 27 and the interfiber binder material are chemically removed.

The discs 29 illustrated in FIGS. 2B and 3, and which are disposed on a display plate 16, 21, as shown in FIG. 5, are then briefly exposed to an organic solvent or other chemical etchant which is selective to the glass fibers 18.

Kindt-Collins type K fixturing wax is useful as a binder in a fiber bundle 28 for maintaining the fibers 18 in their relative positions during slicing, and subsequent disposition on a display plate 16, 21. Hexane is used to dissolve the Kindt-Collins type K fixturing wax after the slices 29 have been disposed on the display plate 16, 21. Hexane may also be used to recess the wax to a level below that of the ends of the glass fibers 18 in the slice 29, prior to the slice 29 being disposed on the display plate 16, 21 to aid in a more residue-free and more certain adhesion of the fibers 18 to the display plate 16, 21.

Figure 6:
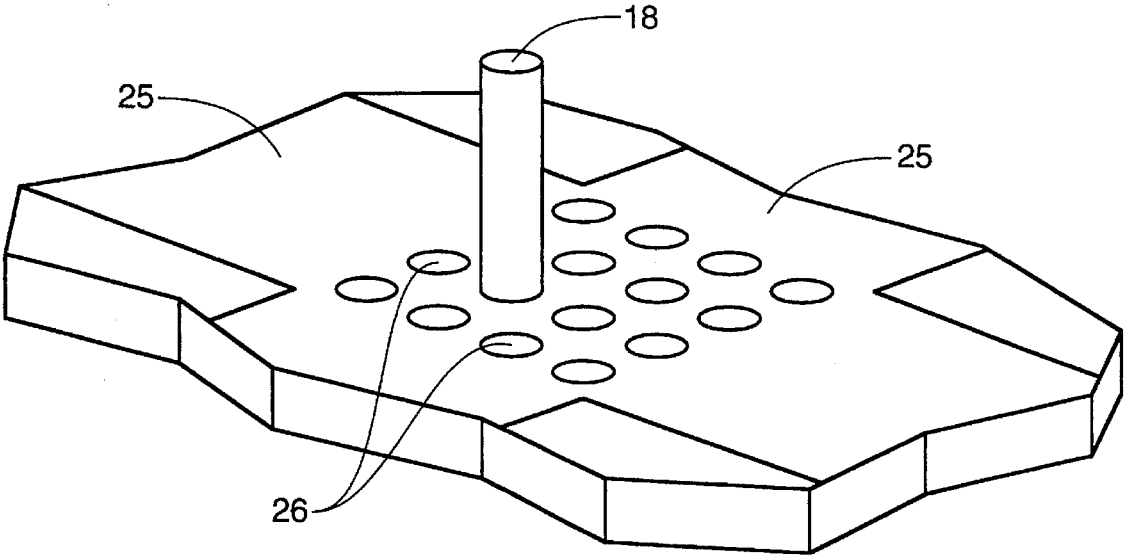
FIG. 6 is a schematic cross-section of a spacer support structure, fabricated according to the process of the present invention.

Then the glass fibers 18 which did not contact an adhesion site 26 are also physically dislodged, when the binder between the glass fibers 18 is dissolved, thereby leaving a distribution of high aspect ratio micro-pillars 18. This results in glass fibers 18 in predetermined locations that protrude outwardly from the display plate 16, 21, as shown in FIG. 6. Preferably the spacers 18 are disposed substantially perpendicular to the surface of the display plate 16, 21.

The inventive use of the bundle slices 29 is a significant aid in providing substantially perpendicular placement of the spacers 18.

All of the U.S. Patents cited herein are hereby incorporated by reference herein as if set forth in their entirety.

While the particular process as herein shown and disclosed in detail is fully capable of obtaining the objects and advantages herein before stated, it is to be understood that it is merely illustrative of the presently preferred embodiments of the invention and that no limitations are intended to the details of construction or design herein shown other than as described in the appended claims.

One having ordinary skill in the art will realize that even though a field emission display was used as an illustrative example, the process is equally applicable to other vacuum displays (such as flat panel displays), and other devices requiring physical supports in an evacuated cavity.

What is claimed is:

1. A process for forming spacers, useful in large area displays, said process comprising the following steps of:

forming bundles comprising fiber strands, said fiber strands being held together with a binder;

slicing said bundles into slices;

placing said slices on a plate of the display; and removing said binder.

2. The process for forming spacers, according to claim 1, wherein said fiber strands comprise glass.

3. The process for forming spacers, according to claim 2, wherein said binder comprises at least one of: acryloid acrylic plastic resin in an acetone/toluene solvent, $Zein_{TM}$, corn protein in IPA/water based solvent, acryloid/$Zein_{TM}$, polyvinyl alcohol (PVA) resist in water, polyvinyl alcohol (PVA) with ammonium dichromate (ADC) in water; and a wax.

4. The process for forming spacers, according to claim 3, wherein said electrode plate is at least one of a baseplate and an anode screen.

5. The process for forming spacers, according to claim 4, wherein said electrode plate has pixel sites, said strands being adhered outside said pixel sites.

6. The process for forming spacers, according to claim 5, wherein said fiber strands have a diameter substantially in the range of 0.001"–0.002".

7. A method of manufacturing micro-pillars, comprising the following steps of:

forming a bundle of glass fibers, said glass fibers being held together with an adhesive;

slicing said bundles of glass fibers, said glass fibers having ends;

etching back said adhesive on said ends of said glass fibers; and removing said adhesive, thereby creating micro-pillars.

8. The method of manufacturing micro-pillars, according to claim 7, further comprising the step of:

polishing said ends of said glass fibers.

9. The method of manufacturing micro-pillars, according to claim 8, wherein said micro-pillars have a height substantially in the range of 0.010."

10. The method of manufacturing micro-pillars, according to claim 9, wherein said glass fibers are disposed parallel to one another in said bundle, said bundle having a length.

11. The method of manufacturing micro-pillars, according to claim 10, wherein said bundle is sliced at angle substantially normal to the length of said bundle.

12. The method of manufacturing micro-pillars, according to claim 11, wherein said bundle comprises 1000–2000 of said glass fibers.

13. The method of manufacturing micro-pillars, according to claim 12, wherein said glass fibers have a diameter substantially in the range of 0.001"–0.002".

14. A process for fabricating high-aspect ratio support structures, comprising the following steps of:

applying adhesive on an electrode plate of a vacuum display;

disposing discs on said adhesive, said discs comprising fibers and binding; and removing said binding, thereby exposing said fibers.

15. The process for fabricating high-aspect ratio support structures, according to claim 14, wherein said fibers comprise silicon.

16. The process for fabricating high-aspect ratio support structures, according to claim 15, wherein said binding is removed in a solvent, said solvent comprising acetone.

17. The process for fabricating high-aspect ratio support structures, according to claim 16, wherein said binding comprises wax.

18. The process for fabricating high-aspect ratio support structures, according to claim 17, wherein said adhesive comprises at least one of: epoxy, silica, alumina, and phosphate.

19. The process for fabricating high-aspect ratio support structures, according to claim 18, wherein said adhesive is stable at temperatures substantially in the range of 300° 500° C.

20. The process for fabricating high-aspect ratio support structures, according to claim 19, wherein said fibers have ends, said ends of said fibers being polished prior to adhesion to said electrode plate.

21. A process for forming spacers, useful in evacuated displays, said process comprising the following steps of:

forming bundles comprising fiber strands;

slicing said bundles into slices;

disposing said slices on a plate of the display, said fibers from said slices functioning as spacers.

22. The process for forming spacers, according to claim 21, wherein each of said fiber strands have a length which is at least 5 times greater than width.

23. The process for forming spacers, according to claim 22, wherein said width of each of said fiber strands is less than 50 μm.

24. The process for forming spacers, according to claim 22, wherein said length of each of said fiber strands is greater than 0.005".

25. The process for forming spacers, according to claim 21, wherein said fiber strands comprise at least one of glass and PMMA.

26. The process for forming spacers, according to claim 21, wherein said fiber strands have a coating, said coating being useful for maintaining a substantially uniform distance between said fiber strands and for effecting electrical bleed off.

27. The process for forming spacers, according to claim 21, wherein said bundle has a cross-section having a length substantially in the range of 0.25"–2.0".

28. A process for forming micro-pillars, useful as support structures in a vacuum cavity of a flat panel display device, comprising the following step of:

placing fibers on a substrate, said fibers being disposed perpendicular to said substrate, said fibers being parallel to one another, said fibers having a substantially uniform length.

* * * * *